United States Patent [19]

Fegley

[11] 4,062,303

[45] Dec. 13, 1977

[54] FLUID DISPENSING ANTI-BURGLAR BOOBY TRAP DEVICE

[76] Inventor: Charles Robert Fegley, 1606 Frush Valley Road, Laureldale, Pa. 19605

[21] Appl. No.: 699,519

[22] Filed: June 24, 1976

[51] Int. Cl.[2] ..... E05G 1/12

[52] U.S. Cl. ..... 109/29; 109/43

[58] Field of Search ..... 109/20, 29, 31, 32, 109/38, 43; 248/295

[56] References Cited

U.S. PATENT DOCUMENTS

| | | | |
|---|---|---|---|
| 1,405,641 | 2/1922 | Ullman | 109/32 |
| 1,422,903 | 7/1922 | Tiffany | 109/32 |
| 2,526,126 | 10/1950 | Gagnier | 248/295 |
| 3,390,819 | 7/1968 | Grizzle | 109/32 X |
| 3,653,342 | 4/1972 | Chilton | 109/43 X |

*Primary Examiner*—Casmir A. Nunberg
*Assistant Examiner*—David H. Corbin

[57] ABSTRACT

A fluid dispensing anti-burglar booby trap device is disclosed which discharges a fluid, containing a chemical such as tear gas, from a pressurized container into an area to be protected when an intruder opens a door or window to enter an unauthorized area with which the device is associated. The pressurized container is moveably mounted in the anti-burglar device between an actuatable position and an inactuatable position. When the pressurized container is in the actuatable position, opening a door or a window will cause the device to discharge fluid from the pressurized container.

8 Claims, 8 Drawing Figures

FLUID DISPENSING ANTI-BURGLAR BOOBY TRAP DEVICE

BACKGROUND OF THE INVENTION

The invention relates generally to an anti-burglar booby trap device; more particularly to an anti-burglar device which dispenses a fluid containing a chemical such as tear gas from a container containing fluid under pressure, one type being an aerosol container, into a protected area upon actuation by an unauthorized person. This action causes the protected area to be flooded with a chemical, thereby, forcing evacuation of the protected area by the intruder; however, the invention is not limited to the use of the aerosol type container.

Chemical weapons have been known in the art for many years. One type of chemical weapon is the conventional tear gas grenade in which the firing member is generally triggered manually and the grenade is manually hurled at a target area, causing the target area to be flooded with the chemical irritant.

In another type of chemical weapon, the chemical irritant is stored under pressure in an aerosol type container. The firing member is again generally triggered manually and the chemical irritant in the form of a spray is manually directed at a target.

A third type of chemical anti-burglar device discharges an explosive tear gas shell into an area but this type is both dangerous and very limited as to the amount of tear gas which is discharged into the area to be protected.

Thus, what is needed is an anti-burglar device of the fluid dispensing booby trap type which can be actuated by a small amount of mechanical force, yet will release a sufficient amount of fluid containing a chemical into a given area to force evacuation of an intruder. The anti-burglar device uses a container of pressurized fluid having a fluid-dispensing element which is actuated by an object with which the device is associated. The pressurized container is mounted for movement in a body member whereby the pressurized container is moved between an actuable position and an inactuable position. When in the actuable position, the fluid dispensing element is placed into position whereby an object such as a door or window with which the device is associated will cause actuation of the fluid-dispensing element and thereby cause discharge. In the inactuatable position, the anti-burglar device will permit the door or window to be opened without causing the device to discharge.

SUMMARY OF THE INVENTION

The principal object of the present invention is to provide an anti-burglar device of the fluid dispensing type which may be triggered directly by a small amount of mechanical movement, and yet may easily be placed in a non-actuatable condition.

An additional object of the invention is to provide an anti-burglar device of the chemical weapon type which is readily triggered by opening a window or other entry means by an intruder entering an unauthorized area.

Another object of the invention is to provide an improved means of discharging a fluid containing a chemical into the protected area in a minimum amount of time in order to force the intruder from the protected area and to prevent the intruder from re-entering the protected area for a reasonable amount of time.

Yet another object of the invention is to provide an anti-burglar device having means for reloading the device and resetting the actuating member of the weapon to its actuatable position after the device has been discharged.

According to the principle aspect of the present invention, there is an improved means of actuating the fluiddispensing element of a pressurized container. The pressurized container is arranged on suitable mounting means ao that the device may be placed in an actuatable position wherein the fluiddispensing element is in a position to be actuated by a door or window with which the device is associated. When the door or window is moved, the fluid-dispensing element is actuated to cause fluid discharge. By moving the pressurized container to its inactuatable position, the door or window may be moved without causing the device to discharge.

Another object of the invention is to provide an improved valve and valve locking means for dispensing fluid from a pressurized container wherein the valve may be easily actuated with little force and locked in its discharging position.

The anti-burglar device of the present invention may be utilized in homes, factories, farms, office buildings by attaching the device to doors, windows, skylights, etc. and may be used in connection with vehicles such as boats, trucks, etc. The device may also be employed for any other application wherein it is desired to prevent unauthorized persons from moving certain objects by mounting the device in such a manner that unauthorized movement of the objects will cause actuation.

Once actuated, the discharge cannot be stopped by the intruder and the entire amount of pressurized fluid will be discharged into the protected area making it impossible for the intruder to remain in the protected area without having protective equipment.

Other objects, aspects, and advantages of the invention will become apparent from the following description taken in connection with the accompanying drawings.

DESCRIPTION OF THE PREFERRED EMBODIMENTS

Figure 1:
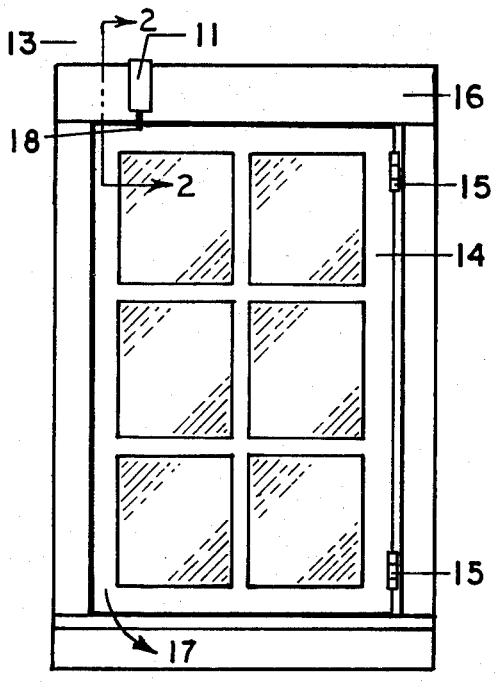
FIG. 1 is an elevational view of a wall of a room having one embodiment of the fluid dispensing anti-burglar device mounted on a window frame for actuation by an unauthorized movement of the window sash.

Referring now to the drawings in detail, wherein like reference characters designate like parts throughout the various views there is shown in FIGS. 1 to 4, one form of the fluid dispensing anti-burglar booby trap device, called device hereafter, of the fluid dispensing type according to the present invention, generally designated 11. The device 11 is shown for convenience as being secured to a surface such as a window frame 16 in wall 13 whereby the device can be actuated by a second surface such as the window sash 14 upon opening of the window sash 14 by an intruder. The device 11 will discharge a fluid 50 containing a chemical such as tear gas into the restricted area when actuated.

Figure 2:
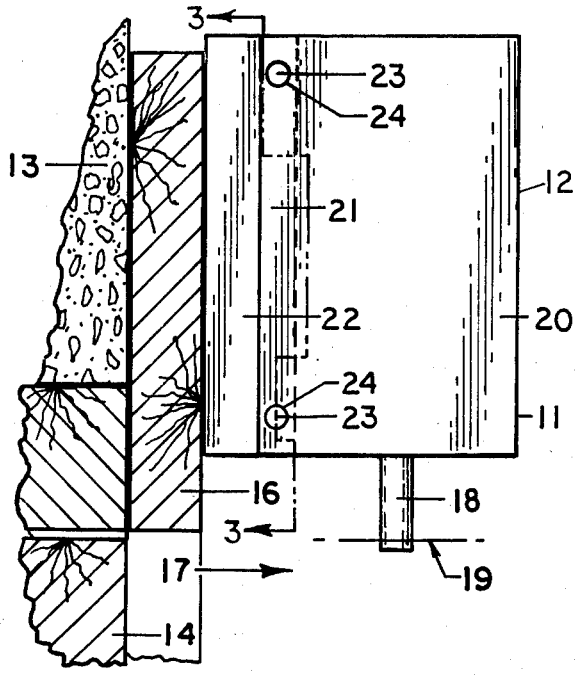
In FIG. 2 is an elevational view of the fluid dispensing anti-burglar device.
Figure 3:
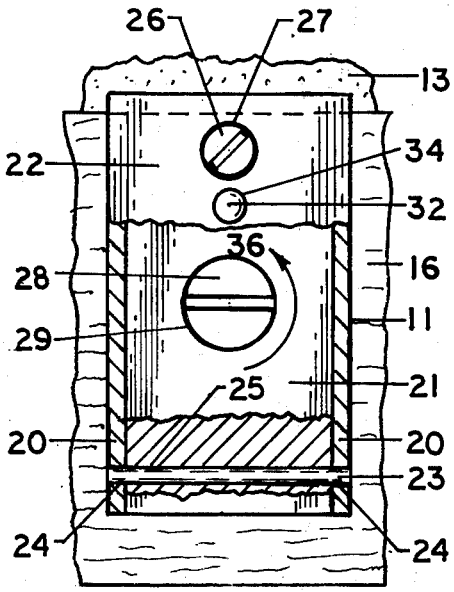
FIG. 3 is a partial cross sectional view showing the mounting means as viewed along line 3—3 of FIG. 2.
Figure 4:
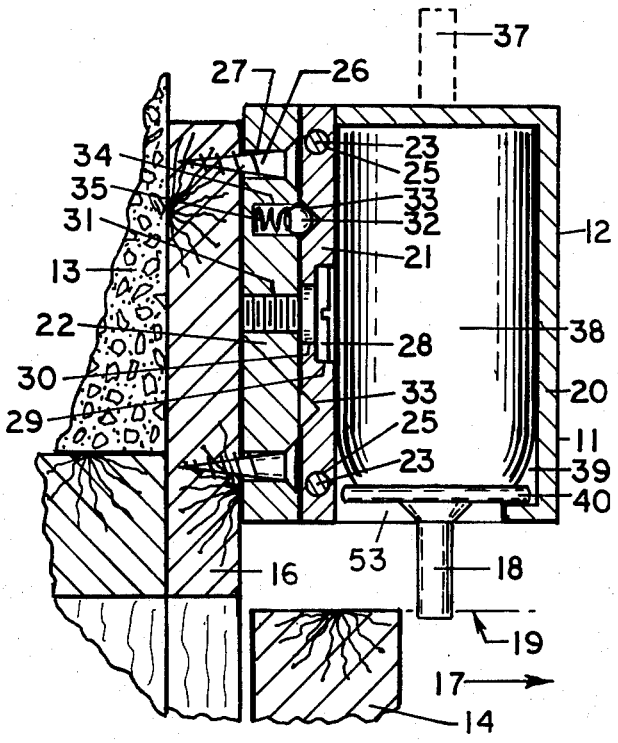
FIG. 4 is a vertical sectional view taken through the center of the device.

The device 11 is shown in FIGS. 2–4 as having container of pressurized fluid, called pressurized container 38 hereafter, supported in a body member 12. The body member 12 is shown for convenience as being comprised of a front body part 20 and a rear body part 21 and includes mounting means which is shown for convenience as holes 27 through mounting plate 22 for attaching device 11 to a first surface shown as the window frame 16 or elsewhere as may be convenient with screws 26.

Figure 5:
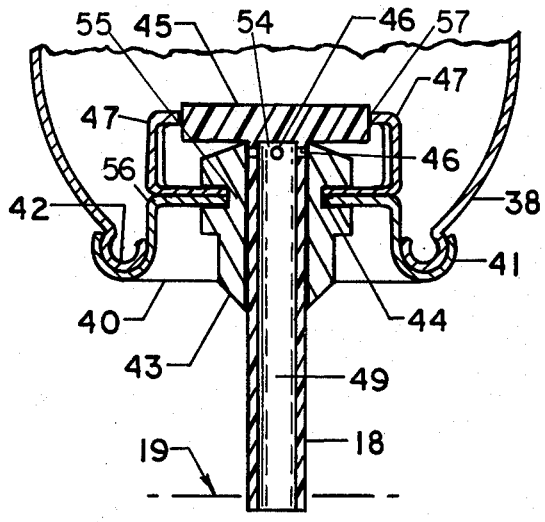
FIG. 5 is a partial vertical sectional view of the container valve assembly for use in the anti-burglar device.
Figure 6:
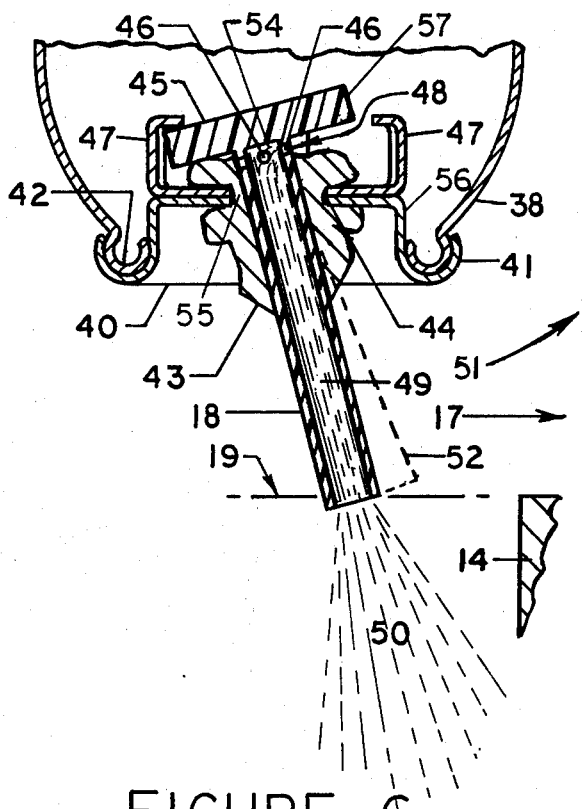
FIG. 6 is a partial vertical sectional view of the container valve assembly similar to FIG. 5 but showing the valve in its actuated position wherein the valve assembly is in its locked discharging position.

As best seen in FIGS. 2-4, the body parts 20 and 21 when assembled form the pressurized container cavity 39 and opening 53. The pressurized container 38 is supported in the cavity 39. One type of pressurized container 38 is shown as having a fluid-dispensing element 18 for use with the valve assembly generally designated 40. One type of valve for use in this embodiment is shown in FIGS. 5 and 6. The valve assembly 40 is comprised of a projecting fluid-dispensing element 18 which has a hollow tube portion 49 and is closed at the one end 54 thereof. The fluid-dispensing element 18 is mounted in the hole 55 of the formed valve cover 56 by the grommet-like seal 43. The formed valve cover 56 is attached to container 38 by the crimped seal 41. The hollow tube portion 49 of the fluid-dispensing element 18 has at the valve end 54 several small discharge holes 46 so that when the dispensing element 18 is tilted from its normal position in any direction 17 the valve end 54 of the fluid-dispensing element 18 will part from the seal 43 and allow the fluid 50 to flow between the valve end 54 and seal 43, through one or more of the discharge holes 46 at arrow 48, through the tube portion 49 of the fluid-dispensing element 18 and into the area being protected. If the fluid-dispensing element 18 is allowed to return to its normal position, the valved end 54 again engages the seal 43 to prevent fluid flow. If it is desired to empty the contents of the pressurized container that the fluid-dispensing element 18 must be kept in the tilted position until the container's contents has been dispensed.

As can be best seen in FIGS. 5 and 6, when the fluid-dispensing element 18 is moved, the valve end 57 will slip under spring clip 47 thereby preventing the fluid-dispensing element 18 from returning to its sealed state. It is important that the spring clips 47 be tensioned to move toward each other so that they can get a firm grip on the valve end 57 to hold it in the discharge position although most anti-burglary applications would require the discharging all of the contents of the pressurized container; it is recognized that for certain applications it may be desired to dispense a small quantity of the chemical. For applications requiring the discharge of a portion of the contents of the pressurized container, the spring clip 47 could be eliminated thereby permitting the dispensing element to close the valve.

Now referring to FIGS. 2 to 4, the body member 12 is comprised of body parts 20 and 21 which mount container 38. The body member 12 is mounted for movement shown for convenience as being rotatable on a mounting plate 22. A shoulder screw 28 provides means for rotatably mounting the body member 12 to the mounting plate 22. A spring 35 is positioned in hole 34 of mounting plate 22 for biasing a detent shown as a ball 32 which acts on groove 33 in body member part 21 to position the pressurized container 38 with the fluid-dispensing element 18 in an actuatable position or an inactuatable position.

By rotating the body member 12 to the actuatable position shown in FIGS. 2 and 4 wherein the fluid-dispensing element 18 is in a position to be moved by the window sash 14 upon movement of the window sash 14 in direction of 17; the fluid dispensing element 18 will be moved to its discharge position. The device 11, will, in this position, discharge its contents into the protected area.

By moving the body member 12 to the inactuatable position wherein the fluid-dispensing element is in position 37, shown dotted in FIG. 4, the door or window can safely be opened and closed without causing discharge.

Although the device is shown as being rotatably mounted between an actuatable position wherein the fluid will be discharged when the fluid-dispensing element is actuated and an inactuatable position. It is recognized that the device may be moved from one position to another by other means such as by slidably mounting.

Figure 7:
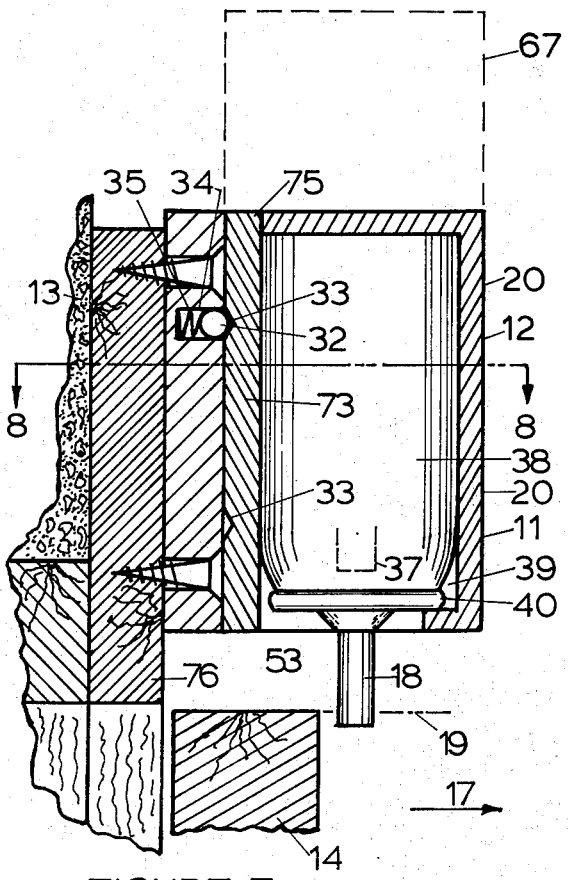
FIG. 7 is an elevational view showing a second embodiment of the fluid dispensing anti-burglar device wherein the pressurized container is slidably mounted.
Figure 8:
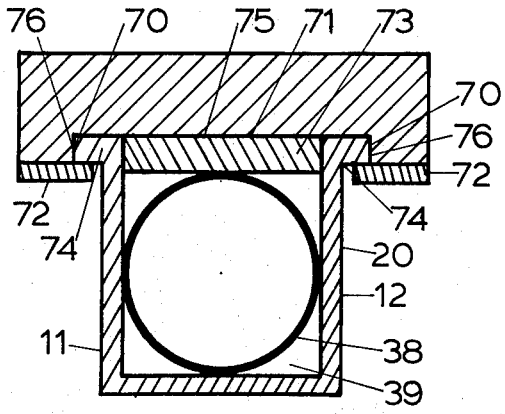
FIG. 8 is a sectional taken along line 8—8 of FIG. 7.

Therefore, a second embodiment of the invention is illustrated in FIG. 7 and 8. In this embodiment, the basic structure is as previously described and like numbers are used to indicate like or corresponding parts.

In this embodiment, the shoulder screw 31 and the related mounting means for rotating the pressurized container is replaced by a means for slidably mounting the pressurized container. The rear housing part 21 of the first embodiment is replaced with a rear housing part 73 having surfaces 74, 75 and 76 for slidably engaging with surfaces 70, 71 and 72 of the mounting plate 69. All other elements function as previously described except that the pressurized container is moved by sliding instead of rotating; or the device could be positioned vertically or horizontally by using a dip tube inside the pressurized container.

The device herein shows the pressurized container having the fluid-dispensing element positioned in the downmost position for use with fluids in liquid form. It is recognized that by mounting the device with the fluid dispensing element positioned on the top of the pressurized container, fluids in gaseous form may be discharged.

Although I have herein shown and described the invention in what I have conceived to be the most practical and preferred embodiments, it is recognized that the scope of my invention, which is not to be limited to the details disclosed herein but is to be accorded the full scope of the claims so as to embrace any and all equivalent structures and devices.

I claim:

1. A fluid dispensing anti-burglar booby trap device for attachment to a surface such as a wall wherein said device is associated with a second surface such as a door and arranged such that movement of the second surface will cause said device to dispense a fluid in the event unauthorized opening is attempted, the device comprising:

a. a container of pressurized fluid having a fluid-dispensing element adapted to release fluid under pressure when actuated;

b. a passageway in said fluid-dispensing element for directing fluid from said pressurized container;

c. a body member having means for supporting said pressurized container;

d. a mounting plate for securing said device to one surface having means for movably mounting said body member whereby said body member may be moved between an inactuatable position and an actuatable position, said body member when in said inactuatable position permitting movement of said second surface with which the device may be associated, said body member when in said actuatable position placing said fluid-dispensing element of said pressurized container in position to be actuated upon unauthorized movement of said second surface.

e. and means for moving said fluid-dispensing element by a second surface from a first position to a second position whereby upon movement of one surface relative to the other said fluid-dispensing element is actuated to release said pressurized fluid from said container when said body member is in said actuatable position.

2. The invention of claim 1 wherein said pressurized container includes a dispensing valve actuated to permit fluid discharge therethrough upon movement thereof, said valve being actuated to a fluid release position through movement to cause discharge.

3. The fluid dispensing anti-burglar device of claim 2 wherein said valve pressurized container contains a projecting dispensing spout, said dispensing spout discharging fluid upon movement thereof.

4. The fluid dispensing anti-burglar device of claim 1 wherein said body member is mounted for rotation between said actuation position and said inactuatable position.

5. The fluid dispensing anti-burglar device of claim 1 wherein said body member is mounted for sliding movement between said actuation position and inactuatable position.

6. The fluid dispensing anti-burglar device of claim 1 wherein said fluid-dispensing element contains a means for locking said fluid-dispensing element in its discharge position.

7. The fluid dispensing anti-burglar device of claim 1 wherein said fluid-dispensing element contains a spring biased locking means, said spring biased locking means locking said fluiddispensing element in its discharge position.

8. The fluid dispensing anti-burglar device of claim 1 wherein said moveable supporting means includes spring biased detents for supporting said pressurized container in the selected position.

* * * * *